US005638804A

United States Patent [19]

Remick et al.

[11] Patent Number: 5,638,804

[45] Date of Patent: Jun. 17, 1997

[54] ARCHERY BOW

[76] Inventors: Robert E. Remick, P.O. Box 607, Cedar Key, Fla. 32625; James D. Henceroth, 892 Williams Ave., Ravenna, Ohio 44266

[21] Appl. No.: 613,629

[22] Filed: Mar. 11, 1996

[51] Int. Cl.[6] ..... F41B 5/10

[52] U.S. Cl. ..... 124/25.6; 124/900

[58] Field of Search ..... 124/23.1, 25.6, 124/86, 88, 900

[56] References Cited

U.S. PATENT DOCUMENTS

| | | | |
|---|---|---|---|
| 2,714,377 | 8/1955 | Mulkey | 124/23.1 |
| 4,227,509 | 10/1980 | Jones | 124/25.6 |
| 4,287,867 | 9/1981 | Islas | 124/25.6 |
| 4,512,326 | 4/1985 | Jarrett | 124/25.6 |
| 4,756,295 | 7/1988 | Guzzetta | 124/25.6 X |
| 5,150,699 | 9/1992 | Boissevain | 124/25.6 |
| 5,205,269 | 4/1993 | Guzzetta | 124/25.6 |
| 5,388,564 | 2/1995 | Islas | 124/25.6 |
| 5,535,727 | 7/1996 | Helmuth | 124/25.6 |

*Primary Examiner*—John A. Ricci

[57] ABSTRACT

An archery bow which requires less force to hold the bow at full draw than to draw the bow through intermediate positions of the draw includes an elongate riser with handle mounted thereon and crank assemblies rotatably mounted at either end thereof. Strut assemblies are pivotally mounted to the crank assemblies and extend outwardly therefrom. A bowstring extends between the outer ends of the strut assemblies. Back lines extends from the outer ends of the strut assemblies to the riser to stabilize and guide movement of the struts as the bowstring is drawn to cause rotation of the crank assemblies or the bowstring is released to allow movement of the bowstring back to its rest or brace position. At least one energy storage limb, and preferably an energy storage limb for each crank assembly, are coupled to the crank assemblies so that rotation of the crank assemblies in response to drawing the bowstring cause deformation of the limbs and energy storage therein, and release of the bowstring from a drawn position results in release of energy from the limbs causing rotation of crank assemblies and movement of the struts to forcibly move the bowstring from drawn to rest or brace position. Timing cables extending between the crank assemblies synchronize rotation of the crank assemblies. The energy storage limb preferably take the form of C-limbs.

20 Claims, 10 Drawing Sheets

FIG. 7
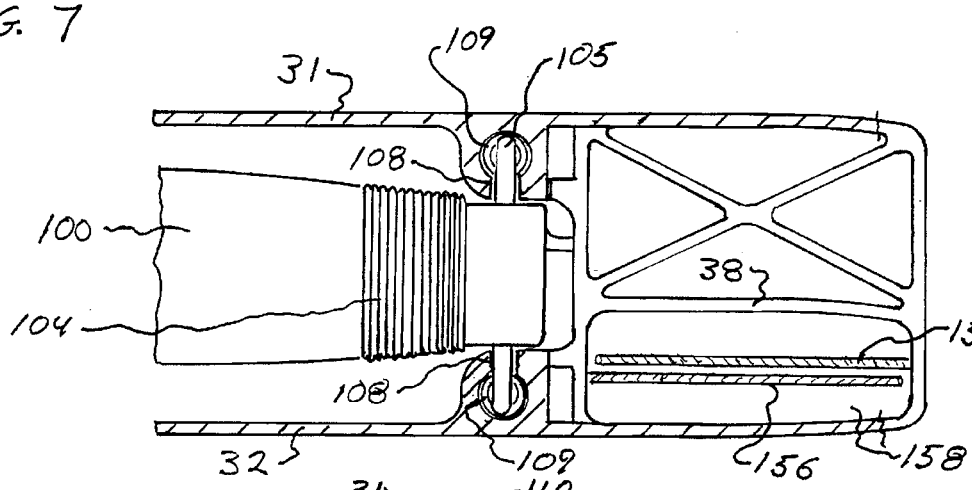
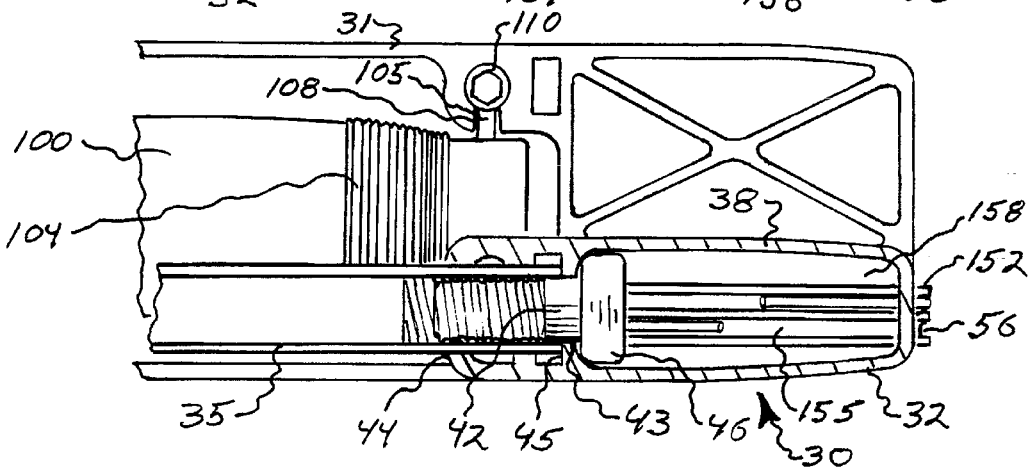
FIG. 8
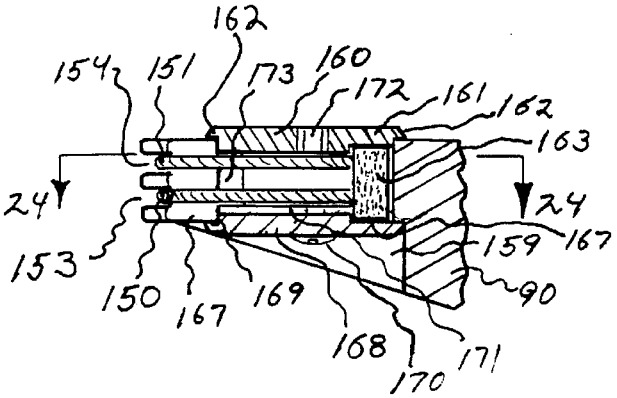
FIG. 23
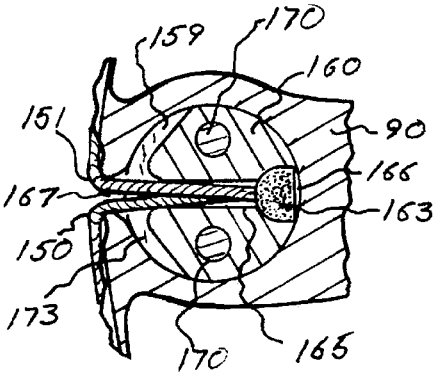
FIG. 24

ARCHERY BOW

BACKGROUND OF THE INVENTION

1. Field

The invention is in the field of archery bows of the type wherein the force required to draw the bow is greater than the force required to hold the bow in its drawn position.

2. State of the Art

Most archery bows include a handle or riser section with a pair of elongate limbs fixed thereto and extending from opposite ends thereof. A bowstring is coupled to the free ends of the limbs so that upon drawing the bowstring, the limbs are deformed, thereby storing energy in the limbs. Upon release of the bowstring, the deformed limbs forcefully return to their rest positions, releasing the stored energy to the bowstring and an arrow nocked thereon. Such bows are normally designed to have a certain draw length and draw weight. With traditional compound archery bows, eccentrics are rotatably mounted on the outer ends of the upper and lower limbs, respectfully. The eccentrics determine the characteristics of the force-draw curve of the bow and provide a let-off, i.e., a reduction of the force required to hold the bow in drawn position as opposed to the force required to draw the bow through intermediate positions of the draw. The let off provided for a particular compound bow is normally designed into the bow and is related to the draw weight and draw length. Adjustment of the draw weight and draw length of the bow can usually be made within certain ranges by changing the length of the bowstring, the attachment of the limbs to the handle, the length of the buss cables, and/or the size or configuration of the eccentrics. Usually, such adjustment is difficult for the archer to perform himself and the range of adjustment is limited. In addition, all adjustments are interrelated so that, for example, an adjustment of the bow limbs to increase the draw weight, also changes the draw length. Further, the efficiency of traditional compound bows which provide relatively substantial limb tip travel to move the bow string from drawn to rest position is limited by the mass of such limb tips and associated eccentrics which must accelerate and move from the drawn to rest positions.

Various attempts have been made to increase the efficiency of a bow and to make adjustment of the draw length, draw weight, and let off easy for the archer and relatively independent of one another. These attempts have generally included pivoting the limbs of the bow to the riser section, making the limbs very stiff to minimize deformation, and providing some type of energy storage means, such as a spring, coupled to the bow limbs to store energy as the bow limbs pivot about their mounting to the riser as the bow is drawn. However, such bows have not been entirely satisfactory and have not gained acceptance and wide use. Room remains for a bow with increased efficiency and increased ease of adjustment of the draw length, draw weight, and let off.

SUMMARY OF THE INVENTION

According to the invention, an improved archery bow is constructed with crank assemblies mounted for rotation at opposite ends of a riser. The crank assemblies are coupled to opposite ends of a bowstring through strut assemblies pivotally attached to respective crank assemblies and the crank assemblies are coupled to energy storage means such as limbs or springs. Drawing of the bowstring acts through the strut assemblies to cause rotation of the crank assemblies which, in turn, cause storage of energy in the energy storage means. Upon release of the bowstring, the energy storage means cause rotation of the crank assemblies which, through the strut assemblies, cause the bowstring to forcibly move from its drawn position back to its rest or brace position. The coupling of the crank assemblies to the energy storage means is the principal determinant of the draw length and let off. Adjustment of the coupling may be made substantially independently of the draw weight and brace height of the bow. The draw weight may be adjusted by adjusting the energy storage means which is done substantially independently of the draw length. An adjustable handle on the riser may be used to adjust brace height of the bow, i.e. the distance from the handle to the bowstring in its rest position. This will also affect the draw length which will need to be compensated for movement of the handle. The let off provided by the bow at full draw for any given coupling of the crank assemblies to the energy storage means is adjusted by adjusting the amount of rotation of the crank assemblies, and that adjustment will have a small effect on the draw length adjustment. Thus, the draw length, let off, and brace height adjustments are interrelated to some extent, however, these may be easily adjusted by the user over a much wider range than possible with conventional bows. The draw weight adjustment is substantially independent of the other adjustments.

The struts of the strut assemblies are preferably of lightweight construction and are balanced or guided to provide a controlled movement during movement of the bowstring. It is preferable that the struts be arranged so that the load on the struts occur along the axis of the struts. This allows a lighter weight construction of the struts than otherwise might be necessary since the struts are only subject to compression loads. The lightweight struts have less mass and inertia than the traditional compound bow limb tips which include the cams mounted thereon. This helps increase the efficiency of the bow.

With the bow of the invention, the high energy components are isolated at either end of the bow and the forces exerted by the strut assemblies are directed substantially outwardly at each end of the bow to substantially cancel each other as far as the bow itself is concerned, these factors result in less vibration and recoil of the bow adding to the efficiency and making the bow relatively quiet and smooth to shoot.

Means is preferably provided to coordinate or synchronize movement of the first and second crank assemblies so that the crank assemblies will rotate together and to the same extent during drawing and firing of the bow. Such coordination means may take the form of timing cables secured to the respective crank assemblies to ensure that each crank assembly rotates in a synchronized fashion. With the coordination means to ensure synchronized rotation of the crank assemblies, the bow could be constructed with a single energy storage means coupled directly to just one of the crank assemblies. Coupling to the second crank assembly, in such instance, is through the coordination means.

In a preferred embodiment of the invention, the bow includes an elongate riser with a first crank assembly rotatably mounted to one end of the riser and a second crank assembly rotatably mounted to the opposite end of the riser. A first limb, in the form of a C-spring, forms an energy storage means and has one end pivotally connected to the one end of the riser and has an outer end connected by cable means to the first crank assembly. Guide means in the form of guide cables extend from the outer end of the limb to guide movement of the outer end of the limb and to restrain rotational movement of the limb about its pivot connection.

A second limb, substantially identical to the first limb, has one end pivotally connected to the opposite end of the riser and has an outer end connected by cable means to the second crank assembly. Guide means in the form of guide cables also extend from the outer end of the second limb to guide movement of the outer end of the limb and to restrain rotational movement of the limb about its pivot connection. A first strut is pivotally secured to the first crank assembly and a second strut is pivotally secured to the second crank assembly. A bowstring extends between the ends of the struts opposite their attachment to the crank assemblies. Two back lines extend from the end of each strut to provide stabilization and guidance for the strut and counteract substantially all but the axial compressive force applied by the bowstring to the struts. As the bowstring is drawn from its rest position, drawing of the bowstring causes movement of the struts and rotation of the crank assemblies. Rotation of the crank assemblies cause, through their connection to the outer ends of the bow limbs, deformation of and energy storage in the limbs. This occurs because, as the respective crank assemblies rotate during draw of the bow, the respective cable means connecting the crank assemblies to the outer ends of bow limbs wind or wrap onto the crank assemblies, thereby shortening the length of the cable means extending between the crank assemblies and the outer ends of the limbs and deforming the limbs by drawing the ends of the limbs closer to the crank assemblies. This stores energy in the limbs. The rate of energy buildup is governed by the shape of the surface of the crank assembly on which the cable means is wrapped. This shape also controls the draw length and let off characteristics of the bow. The shape of the surface of the crank assembly on which the cable means is wrapped is considered part of the coupling of the crank assembly to the energy storage means and may be easily adjusted by forming such surface as an easily removable and replaceable cam block.

It is preferred that the coupling of the energy storage means to the crank assembly and the connection of the strut means to the crank assembly be located on the crank assembly on the same side of the crank assembly axle. In this way, the forces on the crank assembly counteract one another and the force or load on the axle is significantly reduced over the load usually present on the eccentric axles of a conventional compound bow.

The invention also includes the use, as energy storage means in an archery bow, of C-springs or C-limbs made up of one or more C-springs. Such C-springs or C-limbs have been found to be relatively compact for the amount of energy that can be stored therein, to provide a relatively constant rate of increase in spring force over a wide range of compression or deformation, and to allow for a wide range of adjustment of draw weights. In a preferred form of the invention, the C-limb is comprised of two C-springs joined at their ends in spaced relationship and pivotally connected to the bow riser.

THE DRAWINGS

The best mode presently contemplated for carrying out the invention is illustrated in the accompanying drawings, in which:

FIG. 1 is a side elevation of a bow of the invention showing the bow in its rest (undrawn) or brace position;

FIG. 2, a front elevation of the bow of FIG. 1 (taken from the right side in FIG. 1) as would be seen by an archer holding the bow in shooting position;

FIG. 3, a fragmentary side elevation of the lower end of the bow shown in FIG. 1, with one side of the end portion of the riser broken away to show the crank assembly and other internal parts, and drawn to a larger scale;

FIG. 4, a fragmentary transverse section taken on the line 4—4 of FIG. 3, drawn to a larger scale and showing the crank assembly in elevation;

FIG. 5, a side elevation similar to that of FIG. 1, but showing the bow in a fully drawn position;

FIG. 6, a fragmentary side elevation similar to FIG. 3, of the lower end of the bow shown in FIG. 5 with one side of the end portion of the riser broken away as in FIG. 3 to show the crank assembly and other internal parts, but with the bow in the fully drawn position as in FIG. 5;

FIG. 7, a fragmentary transverse section taken on the line 7—7 of FIGS. 1 and 3;

FIG. 8, a fragmentary transverse section taken on the line 8—8 of FIG. 1;

FIG. 9, a fragmentary vertical section taken on the line 9—9 of FIG. 1 showing the handle for the bow;

FIG. 10, a fragmentary transverse section taken along the line 10—10 of FIG. 4 which is along the axis of the axle mounting the crank assembly;

FIG. 11, a transverse section through the crank assembly of FIG. 4, taken on the line 11—11 of FIG. 4;

FIG. 12, a view similar to that of FIG. 11, but showing the crank assembly rotated to its fully drawn position corresponding to its position in FIG. 6;

FIG. 13 a front elevation of a C-spring limb of the bow, i.e., looking into the C, but not showing any other parts of the bow;

FIG. 14, a fragmentary front elevation of the tip end of the lower strut taken on the line 14—14 of FIG. 3;

FIG. 15, a fragmentary vertical section taken on the line 15—15 of FIG. 14;

FIG. 16, a transverse section taken on the line 16—16 of FIG. 14;

FIG. 17, a vertical section through the outer end of a limb taken on the line 17—17 of FIG. 3;

FIG. 18, a vertical section taken on the line 18—18 of FIG. 17;

FIG. 19, a fragmentary rear elevation of a portion of the lower end of the riser taken on the line 19—19 of FIG. 3;

FIG. 20, an end elevation of the spread mount on the bow of the invention taken on the line 20—20 of FIG. 19;

FIG. 21, a view similar to that of FIG. 20, but showing an alternate mounting of the back line thereto;

FIG. 22, a force-draw curve for the bow of invention;

FIG. 23, a horizontal section taken on the line 23—23 of FIG. 11 showing the timing cable adjuster;

FIG. 24, a vertical section through the timing cable adjuster taken on the line 24—24 of FIG. 23; and FIG. 25, a fragmentary front elevation of an alternate strut means of the invention.

DETAILED DESCRIPTION OF THE ILLUSTRATED EMBODIMENT

Figure 1:
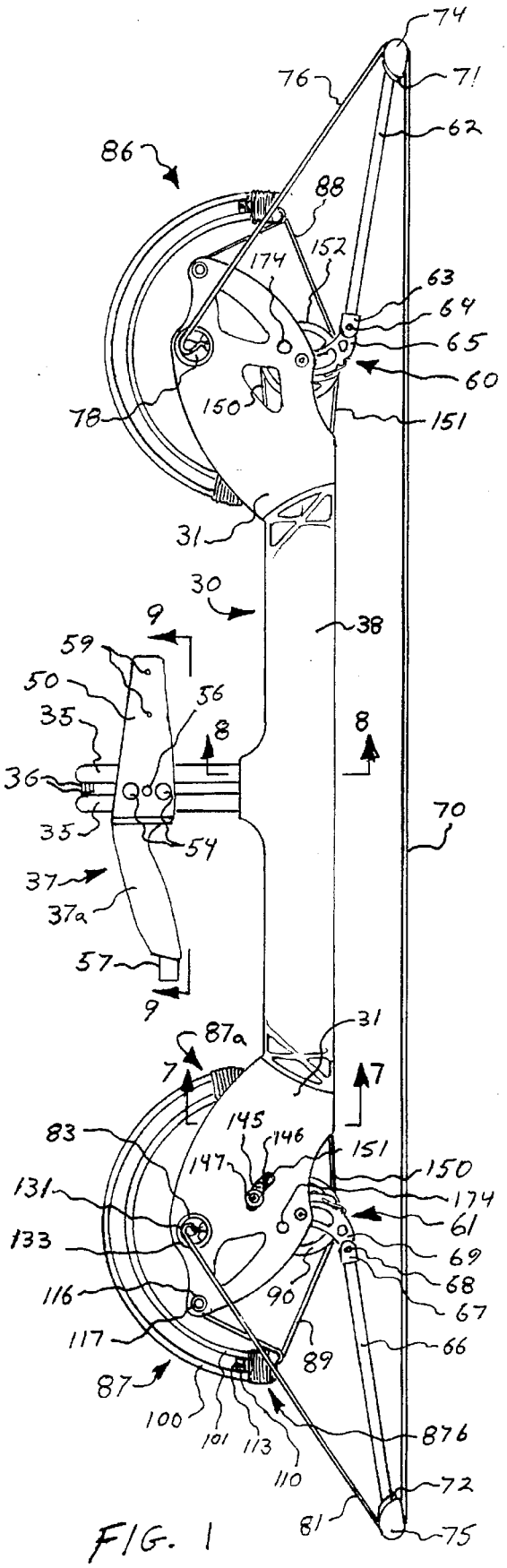

As illustrated, a preferred embodiment of the invention includes a riser 30 forming the main body of the bow. The riser has opposite sides 31 and 32. The interior portion of the riser is cut away at each end leaving an upper riser end slot 33, FIG. 2, between the upper ends of sides 31 and 32 and a lower riser end slot 34 between the lower ends of the sides 31 and 32. The slots 33 and 34 provide a mounting area for various operating components of the bow. A pair of handle slides 35, FIG. 1, joined at their ends by reinforcing cross pins 36, extend from the central portion of the riser 30 for adjustably mounting a handle 37 with hand grip portion 37*a*.

Figure 2:
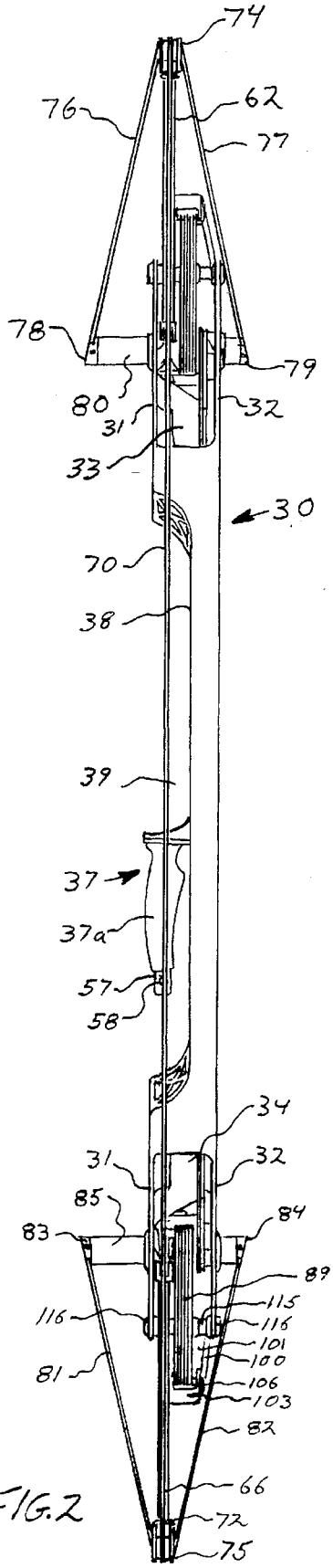

The riser 30 may be made of various materials and, for example, may be machined from a single piece of metal, such as aluminum, may be cast in magnesium or may be built up from several pieces of material. Since cables run through the riser from end to end as will be described, it is preferred that riser 30 be hollow. This also desirably reduces the weight of the riser. It is contemplated that in a preferred form of the invention as illustrated, the riser will be machined from a single length of extruded metal such as an aluminum extrusion. The overall shape of the extrusion is shown in FIG. 7. Various portions of the extrusion are machined away to form various portions of the riser. Thus, for the ends of the riser, the interior portions of the extrusion are machined away leaving only the opposite side walls 31 and 32. For the central portion of the riser, one side of the extrusion, the upper side as shown in FIG. 8, and the left side as shown in FIG. 2, is machined away leaving the intermediate wall 38 as the side wall of the riser through the central portion of the riser rather than wall 31. This forms a center shot window 39, FIG. 2, for the bow.

Each handle slide 35 is secured to the riser by a bolt 42, FIG. 8, which extends from inside the hollow riser through a hole 43. The handle slide 35 is threaded onto bolt 42 and extends through hole 44 in the forward wall of the extrusion to abut extrusion wall 45 through which bolt 42 extends. If desired, an adhesive can be placed on the threads of bolt 42 to securely hold slide 35 thereon. The head 46 of bolt 42 is configured to fit against walls 32 and 38 when in position as shown to keep bolt 42 from turning as slide 35 is screwed thereon.

Figure 9:
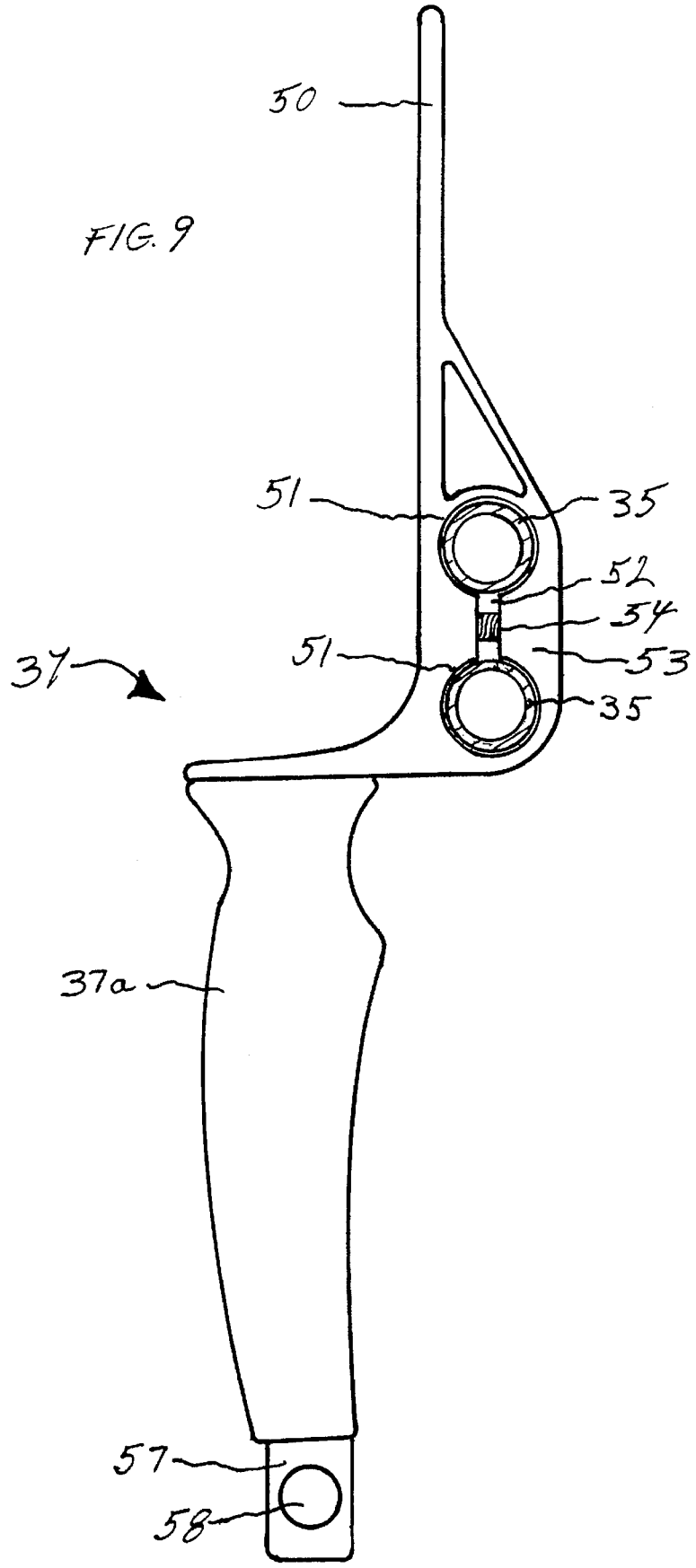

Handle 37, FIG. 9, includes an upper or mounting portion 50 having a pair of circular openings 51 therethrough which receive handle slides 35. A slot 52 extends between openings 51 to form a bridge portion 53, as shown. Screws 54, FIGS. 1 and 9, are threaded into bridge portion 53 so that upon tightening screws 54, bridge portion 53 is drawn inwardly to tightly grip handle slides 35 and thereby hold handle 37 in place. Even through handle upper portion 50 is preferably made of aluminum, it is flexible enough through openings 51 and bridge portion 53 that it can be effectively tightened around handle slides 35. Handle 37 may be adjustably moved along slides 35 by merely loosening screws 54, sliding handle 37 to the desired position, and retightening screws 54. Threaded hole 56, FIG. 1, in handle portion 50 between screws 54 provides a mounting for an arrow rest. A bottom handle extension 57 includes a threaded hole 58, FIGS. 2 and 9, for mounting a stabilizer, if desired. The upper portion 50 of handle 36 includes threaded mounting holes 59, FIG. 1, for mounting a standard bow sight and/or quiver, if desired. With the handle mount as described, the bow of the invention may easily be changed from a right hand bow, as shown, to a left hand bow. This is accomplished by removing the handle, turning the bow upside down, and replacing the handle with a mirror image thereof on the handle slides in the new orientation.

The bow of the invention includes upper and lower crank assemblies, indicated generally as 60 and 61, respectively, FIG. 1, mounted for rotation on the upper and lower ends of the riser 30. The axis of rotation extends between and perpendicular to sides 31 and 32. Upper strut 62 is pivotally attached by end clevis 63 and pivot pin 64 to crank arm 65 of upper crank assembly 60 and extends outwardly therefrom. Similarly, lower strut 66 is pivotally attached by end clevis 67 and pivot pin 68 to crank arm 69 of lower crank assembly 61 and extends outwardly therefrom. A bowstring 70, with end loops 71 and 72 extends between the outer end tips 74 and 75 of the upper and lower struts 62 and 66, respectively, with end loop 71 extending around upper strut 62 and held in place by tip 74 and end loop 72 extending around lower strut 66 and held in place by tip 75, FIGS. 1, 14, and 15. Upper back lines 76 and 77, FIGS. 1 and 2, extend between the outer end tip 74 of upper strut 62 and the respective end securement fittings 78 and 79 of upper spread mount 80, FIG. 2, to balance, stabilize, and guide movement of the upper strut 62. Similarly, lower back lines 81 and 82 extend between the outer end tip 75 of lower strut 66 and the respective end securement fittings 83 and 84 of spread mount 85 to balance, stabilize, and guide movement of the lower strut 66.

Energy storage means, in the preferred embodiment shown taking the form of upper C-spring limb 86 and lower C-spring limb 87, each have an end pivotally connected to an end portion of the riser and an outer end coupled to the respective crank assemblies 60 and 61 by belts 88 and 89, respectively.

Figure 10:
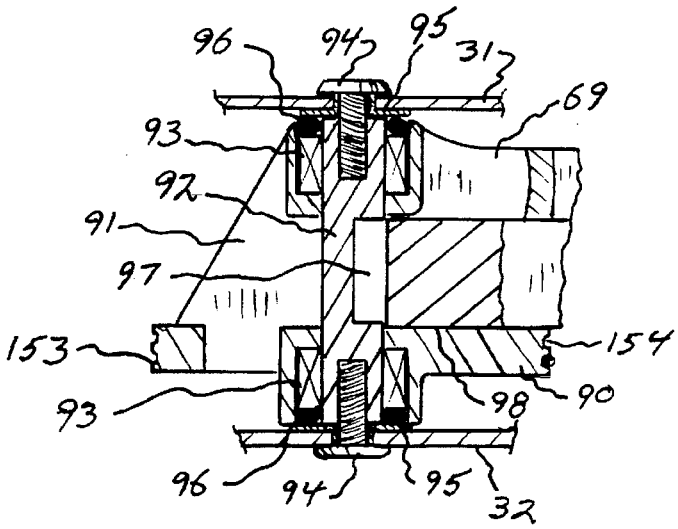
Figure 11:
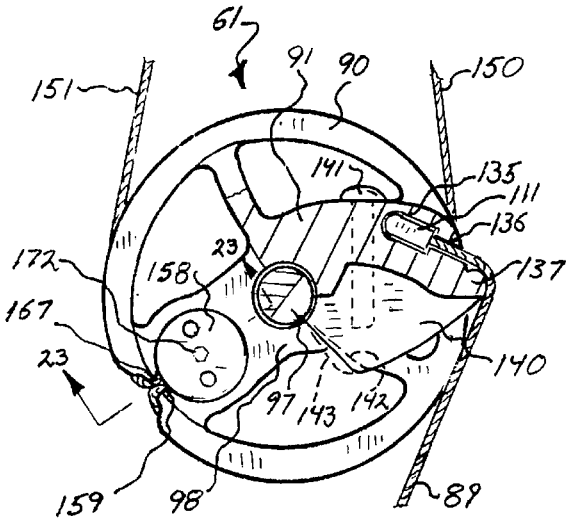
Figure 12:
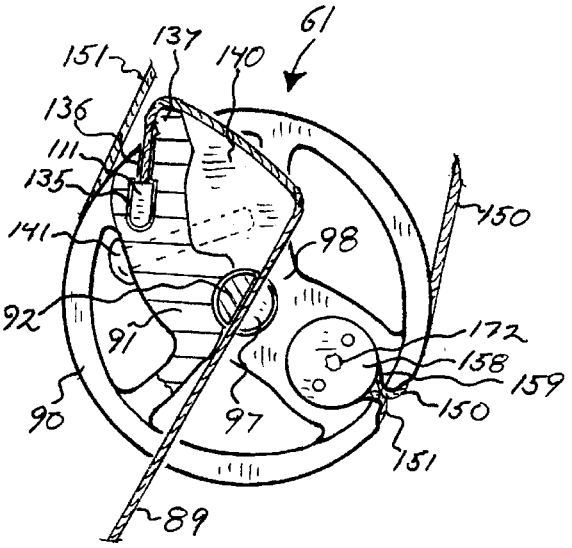

The crank assemblies are mounted at the ends of the riser 30 with upper crank assembly 60 being mounted between sides 31 and 32 in upper end slot 33 and lower crank assembly 61 being mounted between sides 31 and 32 in lower end slot 34. Crank assemblies 60 and 61 are mirror images of one another and are mounted, connected, and operate similarly. Therefore, only the lower crank assembly 61 will be described and shown in detail. Lower crank assembly 61 is shown in greater detail in FIGS. 3, 4, 6, 10, 11, and 12. The crank assembly 61 includes a crank arm portion 69 at one side, a timing cable receiving portion 90 at the opposite side, and a central belt receiving portion 91, FIG. 4, between the crank arm portion and timing cable receiving portion. Crank assembly 61 is mounted for rotation on shaft 92, see particularly FIG. 10, preferably by bearings 93, such as needle bearings, positioned in opposite ends of the crank assembly. Shaft 92 is mounted between sides 31 and 32 by screws 94 which extend through sides 31 and 32 and are threaded into the ends of shaft 92. Washers 95 extend between the ends of shaft 92 and sides 31 and 32 and O-rings 96 are positioned on the ends of shaft 92 to help keep bearings 93 clean. Shaft 92 is stationary, but its rotational position can be adjusted by loosening screws 94, rotating shaft 92 to desired position, and then tightening screws 94 to hold the shaft in that position. Adjustment of shaft 92 may be desirable because, as shown in FIGS. 10, 11, and 12, shaft 92 preferably includes a center cut-out portion 97 which mates with a cut out portion 98, FIG. 11, in the crank assembly on one side of the central belt receiving portion 91. It is generally desirable to have the two cut-out portions aligned or partially aligned when crank assembly 61 is rotated to its fully drawn position. This alignment is shown in FIGS. 11 and 12 which show the crank assembly at rest position in FIG. 11 and at fully drawn position in FIG. 12. It is at the fully drawn position shown in FIG. 12 that it is preferred that shaft cut-out 97 and crank cut-out 98 are fully aligned so that belt 89 passes through shaft cut-out 95.

Figure 13:
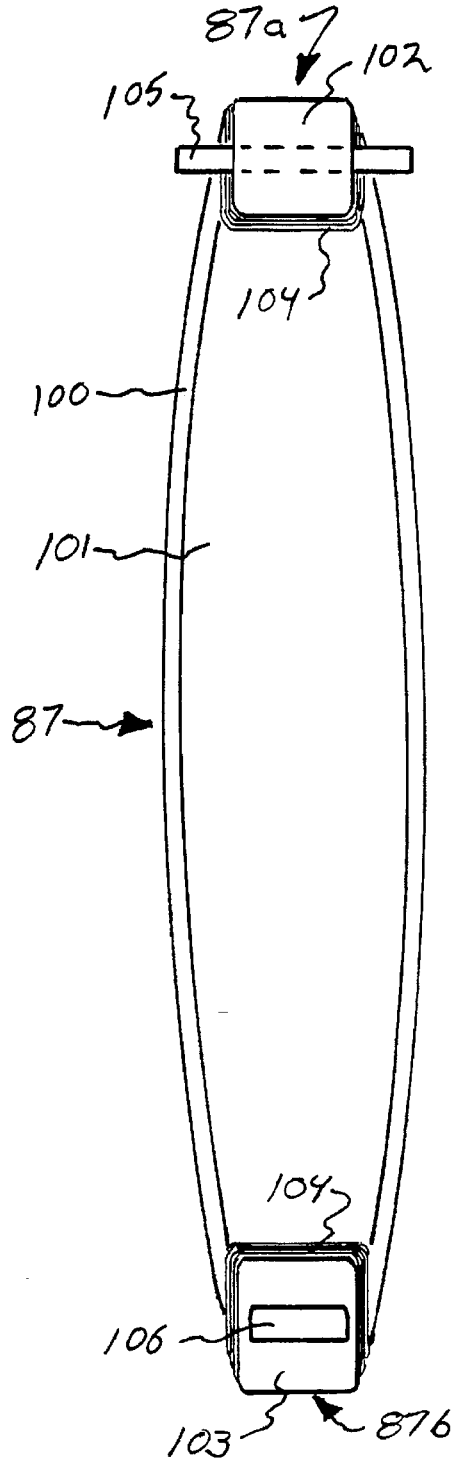

The C-spring limbs 86 and 87 are each constructed and mounted similarly so only the lower limb will be described and shown in detail. As shown, lower C-spring limb 87 comprising an outer C-spring 100 and a spaced, inner C-spring 101, FIGS. 1 and 13, joined at their ends. The preferred springs are made of graphite or fiber glass composite construction and are tapered, FIG. 13, so are narrower at their ends and wider through the middle. Each of the springs has the same amount of taper, but with the inner spring slightly narrower than the outer spring, and of smaller radius, so that both springs are matched and bend together. A unidirectional fiber composite construction for the limbs has been found advantageous. A single layer overwrap of filament material over the unidirectional fibers helps resist failure initiation in the springs and allows the springs to be bent to a greater degree without breakage than normally possible. Aluminum end spacer 102 is glued between corresponding ends of the respective springs to maintain them in spaced apart relationship and form the inner end 87*a* of lower C-spring limb 87, FIGS. 13, 3 and 6, while aluminum end spacer 103 is glued between corresponding ends of the respective springs to maintain them in spaced apart relationship and form the outer end 87*b* of lower C-spring limb 87. Filament wraps 104 of composite material bind the respective ends and respective aluminum spacers together to ensure a strong assembly. A mounting axle 105 extends transversely through spacer 102 while an opening 106 extends axially through spacer 103. The opening 106 provides a mounting for belt 89 and for control lines 107 which extend from the outer end 87*b* of the limb 87 to the riser to control movement of the outer end of the limb.

The inner end 87*a* of C-spring limb 87 is pivotally connected to riser 30 as shown in FIGS. 3, 6, 7, and 8. Mounting axle 105 fits into opposite receiving slots 108 and communicating bores 109 in sides 31 and 32 at the ends of riser 30. Adjustment screws 110 are threaded into bores 109 and hold mounting axle 105 in place. They also adjust the preload, which adjusts the draw weight of the bow, by adjusting the position of mounting axle 105 along slot 108. As will be realized by reference to FIGS. 3 and 6, as screws 110 are screwed further into bore 109, limb mounting axle 105 and the inner end of the limb 87*a* to which it is attached is moved further along slot 108, and, with the opposite or outer end of the limb 87*b* held in position, limb 87 is deformed or compressed as the inner end 87*a* is forced toward end 87*b*.

Figure 3:
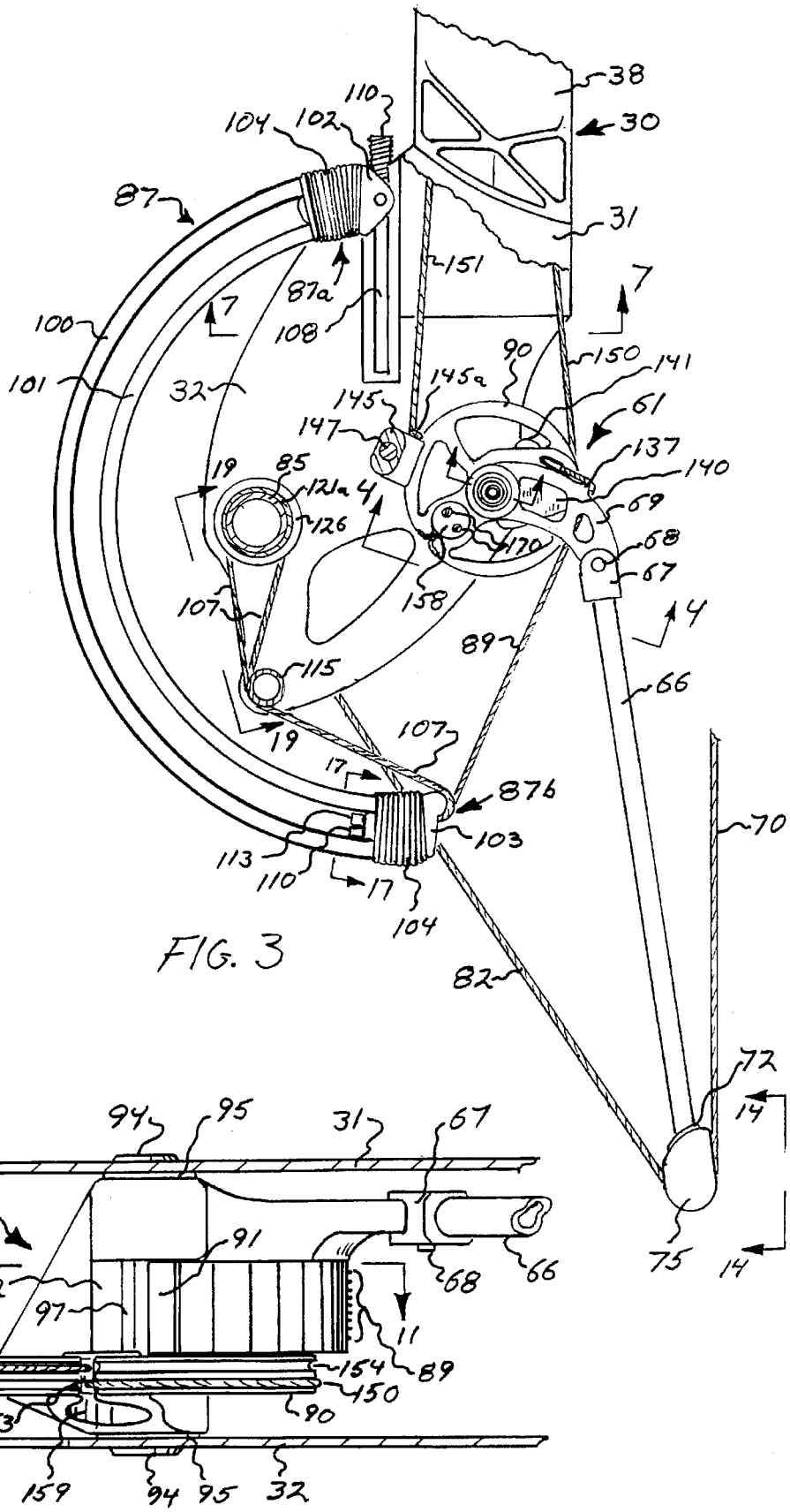
Figure 4:
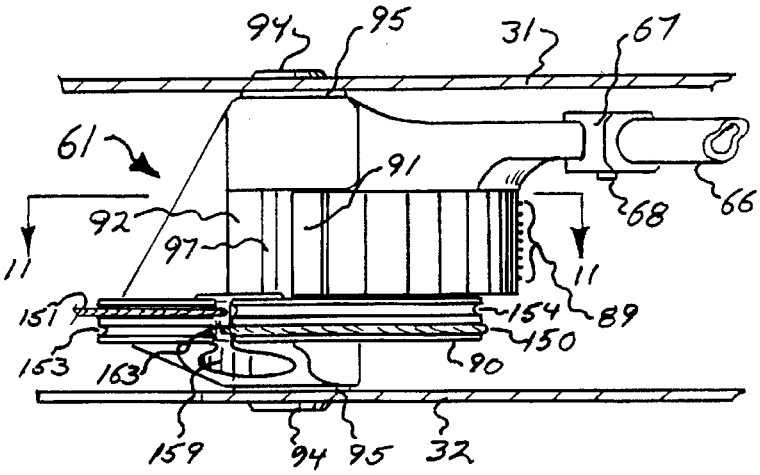
Figure 17:
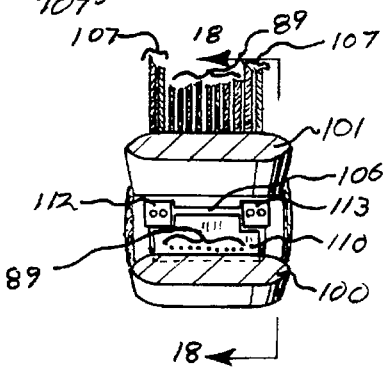

Since the connection of the C-spring limb 87 to riser 30 is a pivot mounting, it is necessary that the outer end 87*b* of the limb, i.e., the end of the limb opposite that connected to the riser, be constrained in its movement so that as crank assembly 61 rotates and winds belt 89 thereon, thereby pulling the outer end 87*b* of the limb toward the crank assembly, limb 87 will compress rather than merely rotate about its pivot connection. Therefore, in addition to belt 89 extending from the outer end 87*b* of limb 87, control lines 107 extend from the outer end of the limb to riser 30. The control lines 107 restrain the rotational movement of limb 87 so that limb 87 is deformed and compressed as crank assembly 61 rotates and winds belt 89 thereon. This is seen from FIGS. 1 and 5 which show the complete bow at rest and fully drawn positions, respectively, and FIGS. 3 and 6 which show the lower end of the bow at rest and fully drawn positions, respectively. Belt 89 may conveniently be made of a plurality of cables in side-by-side position as shown in FIGS. 4 and 17, where seven side-by-side cables make up belt 89. A pair of control cables 107 are preferably provided extending from limb spacer 103 at the outer end of limb 87, with one cable toward one side of the limb and the other toward the other side, with belt 89 between them. Each of the control cables 107 is made up of two side-by-side cables as shown in FIGS. 17 and 19.

Figure 18:
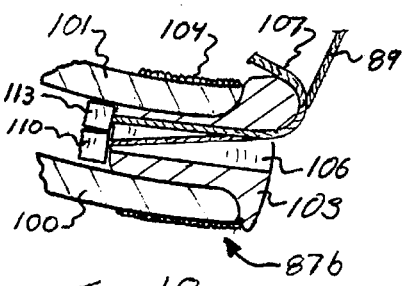

The ends of belt 89 are formed with metal fittings cast onto the ends of the cables as block 110, FIGS. 17 and 18, at the end of the belt attached to limb 87, and block 111, FIGS. 11 and 12, at the end of the belt attached to crank assembly 61. Similarly, the ends of control lines 107, FIGS. 17 and 18, have metal fittings 112 and 113 cast thereon. The metal fittings 110-113 not only hold the side-by-side cables together, but provide a means for securing the lines. Thus, as shown in FIGS. 17 and 18, fitting 110 and the end of belt 89 is passed through opening 106 in spacer 103. Fittings 112 and 113 and the ends of control lines 107 to which they are attached are then also passed through opening 106 in spacer 103 and are positioned adjacent to fitting 110. The belt 89 and control lines 107 are then pulled back through opening 106 until fittings 110, 112 and 113 in the configuration shown in FIGS. 17 and 18, which together, as shown, are larger than opening 106, abut the end of spacer 103 to secure the belt 89 and control lines 107 in the end of the limb. Control lines 107 are preferably formed from a single length of side-by-side cables which extend from securement to the outer end 87*b* of limb 87, around control tube 115, FIGS. 19, 3, and 6, around spread mount 85, back around control tube 115, and back to securement to the end 87*b* of limb 87. Control tube 115, FIG. 19, is secured between sides 31 and 32 by end plugs 116 which pass through holes in the respective sides and are glued into the ends of control tube 115 to secure it in place. End plugs 116 may each be provided with a threaded opening 117 therethrough, FIGS. 1 and 5, which accept the standard threads on standard stabilizers which may be used as balancing rods for the bow, if desired.

Figure 19:
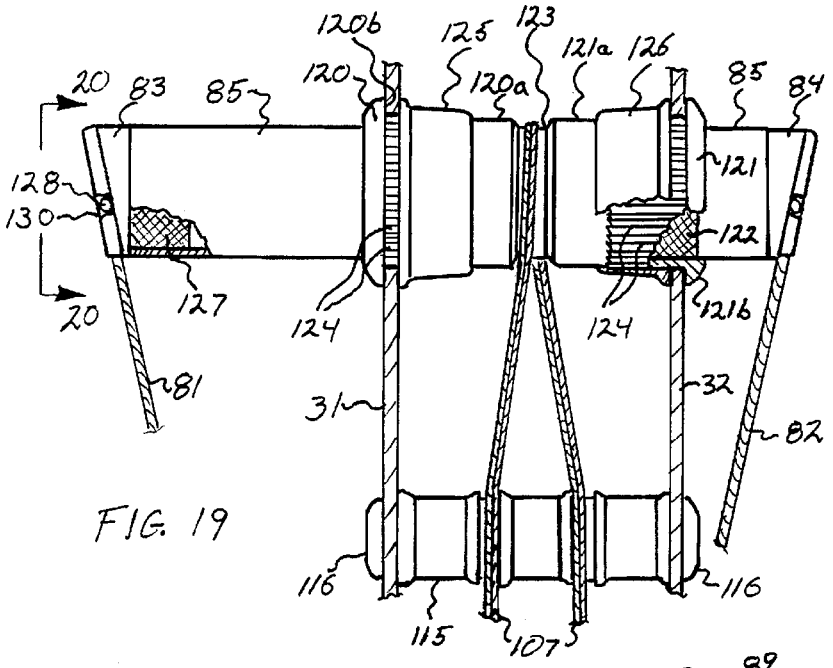

Spread mount 85, FIG. 19, extends through openings in sides 31 and 32 and is secured in place by ring mounts 120 and 121 which are slid into place over spread mount 85 so that shank portions 120*a* and 121*a* extend along spread mount 85 through walls 31 and 32, respectively, and shoulders 120*b* and 121*b* abut walls 31 and 32, respectively. The surface of spread mount 85 is roughened as at 122 where ring mounts 120 and 121 fit thereover so that ring mounts 120 and 121 may be securely glued in place on spread mount 85. The shanks 120*a* and 121*a* of ring mounts 120 and 121 extend along spread mount 85 toward one-another, but leave a space 123 therebetween to accept control line 107 as it extends around spread mount 85. Ring mounts 120 and 121 are preferably made of hard, anodized aluminum with parallel knurling 124 on their shanks which cut into aluminum sides 31 and 32 where the shanks pass therethrough to secure the ring mounts in position so they cannot rotate with respect to sides 31 and 32. Inner rings 125 and 126 are glued in place on the shanks 120*a* and 121*a* of ring mounts 120 and 121 to abut against the inner sides of sides 31 and 32 to ensure that spread mount 85 remains securely in position. Spread mount end securement fittings 83 and 84 have a knurled surface, as at 127, where they fit into the open ends of spread mount 85 so they can each be securely glued into place.

Figure 20:
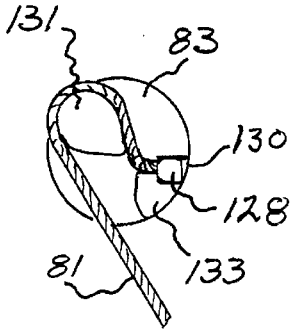
Figure 14:
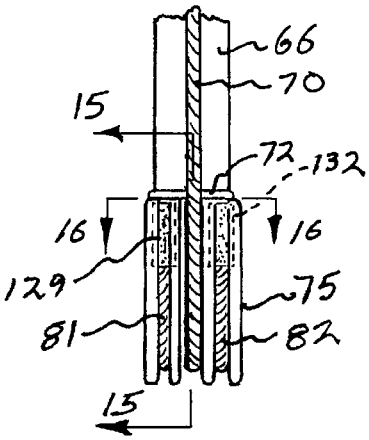
Figure 15:
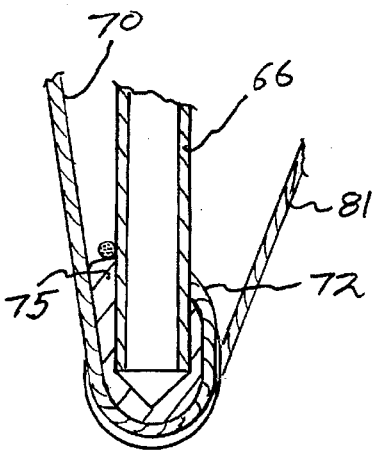
Figure 16:
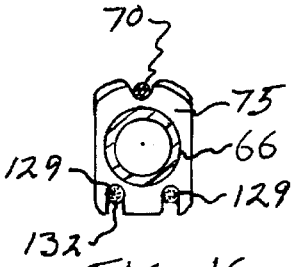

Back lines 81 and 82 are preferably metal cables with metal end fittings 128, FIG. 20, cast on one end and metal end fittings 129, FIGS. 14 and 16, cast on the other end. As shown for back line 81, fitting 128, FIG. 20, fits into receiving recess 130 in spread mount end securement fitting 83. Back line 81 extends around lobe 131 in spread mount end securement fitting 83 and then extends from the back side of lobe 131 to the lower strut tip 75, FIGS. 14, 15, and 16. Fitting 129 on the end of back line 81 fits into one of the receiving openings 132 in strut tip 75. Back line 82 is similarly attached to strut tip 75 by its fitting 129 received in an opening 132 and extends to attachment to spread mount end securement fitting 84 similar to the attachment shown in FIG. 20 for back line 81.

Figure 5:
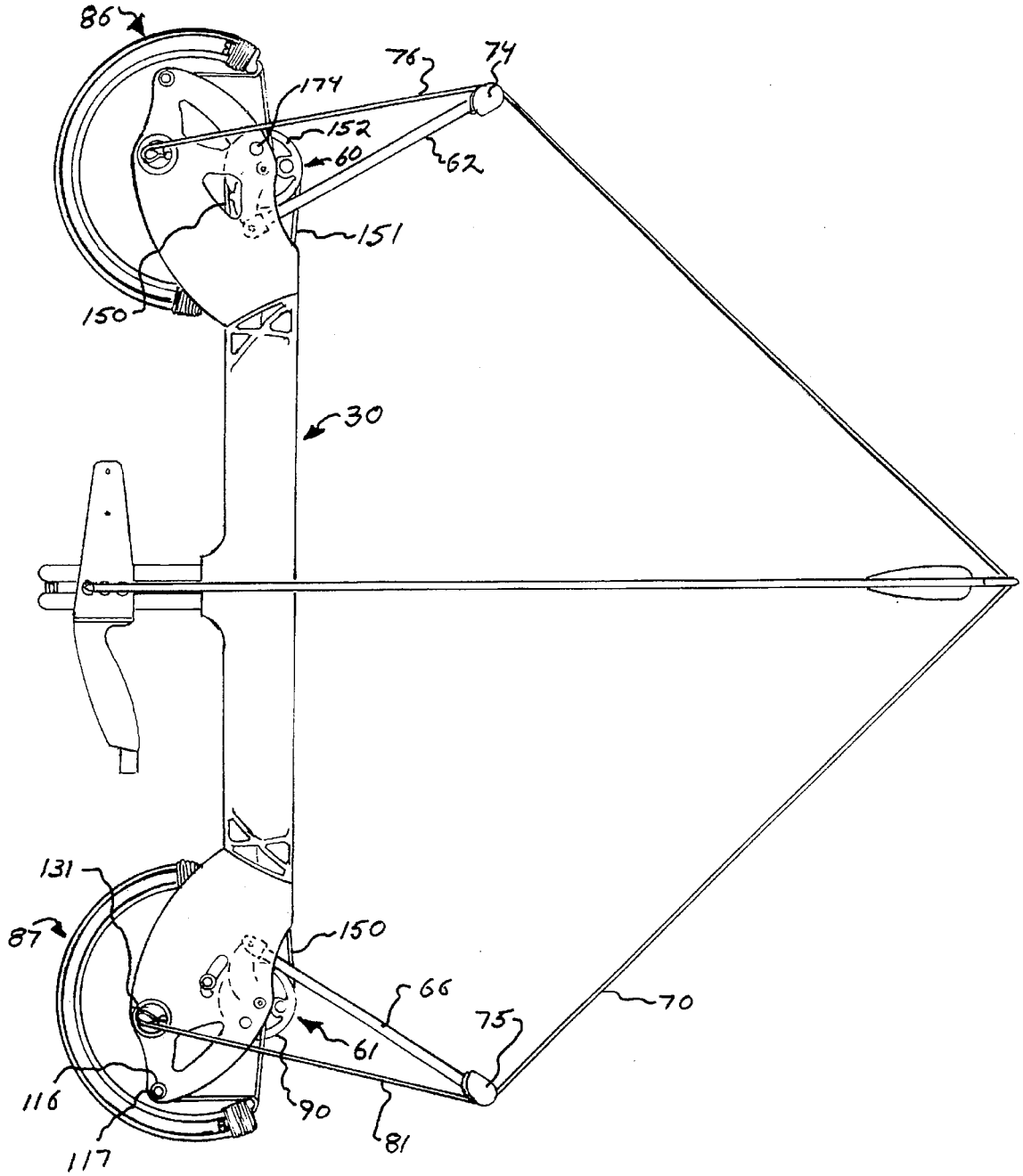
Figure 21:
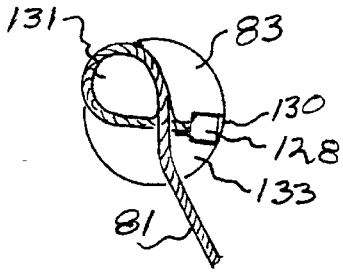

As is apparent from FIGS. 1 and 5, as the bowstring is drawn from rest or brace position, FIG. 1, to fully drawn position, FIG. 5, movement of the end of strut 66 is guided by back lines 81 and 82 which move or rotate about the back side of lobe 131 and describe a path of movement for the tip 75 of strut 66 which is a constant distance from the back of lobe 131. The length of back lines 81 and 82 (the two back lines are the same length) and their point of attachment to spread mount 85 control the movement of the tip 75 of strut 66 and thus are one factor in determining the draw length of the bow. FIG. 21 shows an alternate attachment of back line 81 to spread mount end securement fitting 83. As shown in FIG. 21, line 81 is wrapped around lobe 131 in the opposite direction as shown in FIG. 20 and exits the securement fitting 83 against lobe 133. This places the center of rotation for back line 81 closer to the front of the bow, i.e., the side facing the archer, and will result in less rotation of crank assembly 61 for the amount of draw shown in FIG. 5 and thus allow the bow to be drawn further than shown in FIG. 5 for full rotation of crank assembly 61. This has the effect of lengthening the draw length of the bow, while keeping other characteristics of the bow substantially the same.

As indicated previously, belt 89 extends from attachment to the outer end 87*b* of limb 87 to attachment to crank assembly 61. Belt 89 is attached to crank assembly 61 by inserting end fitting 111 into a receiving opening 135, FIGS. 11 and 12, in crank assembly 61. Belt 89 extends through opening 136 to the outside of crank assembly 61 and around rounded guide member 137. As shown in FIG. 11, and also in FIG. 3, at rest position, belt 89 extends directly from guide member 137 to the end 87*b* of limb tip 87. Thus, the position of guide member 137 determines the position of belt 89 and its distance from shaft 92 at the start of the draw.

As the bow is drawn, crank assembly 61 rotates on shaft 92 and belt 89 is wrapped about a portion of the crank assembly. The length of belt wrapped about the crank assembly for any given amount of rotation of the crank assembly will determine the force draw characteristics or program of the bow, and the total length of belt wrapped about the crank assembly for the amount of rotation providing a full draw for the bow for any given setting of the bow limb will determine the energy stored by the bow at full draw. Further, the distance from the point of contact of the belt with the crank assembly to the axis of rotation of the crank assembly will determine the force required to hold and further draw the bowstring at any point during the draw. Thus, the shape of crank assembly 61 on which the belt is wrapped is a critical factor in determining the operating and force draw characteristics of the bow. In the particular embodiment of the crank assembly shown, the belt is wrapped about the central portion of the crank assembly between the actual crank arm 69 and the timing cable receiving portion 90. While the belt receiving portion of the crank assembly could be a fixed shape and formed integrally with each crank assembly, since the shape is so critical to the operating characteristics of the bow and relatively easy adjustment of such characteristics is desirable, it is preferred that the shape be determined by a removable cam block 140, FIGS. 3, 6, 11, and 12, secured by screw 141 to the central portion of the crank assembly. To aid in easy adjustment of the characteristics of the bow, it is preferred that cam block 140 be positioned as shown in FIG. 11 so that it is not in contact with belt 89 when the bow is in rest or brace position. With this configuration, cam block 140 can be easily removed by unscrewing screw 141 and replaced with a cam block of different configuration when the bow is in rest position.

Figure 22:
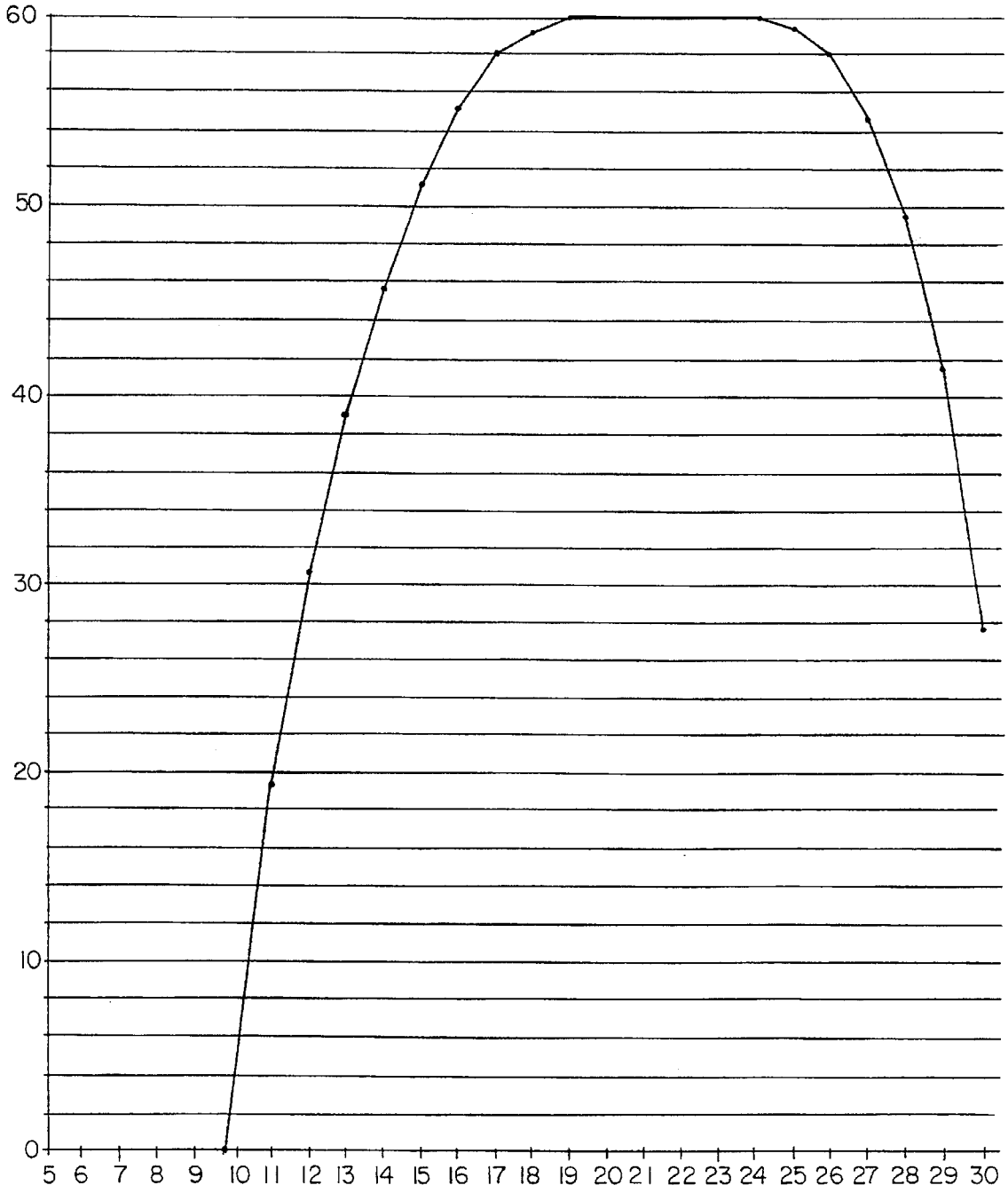

FIG. 22 is a force draw curve illustrative of the characteristics of the bow with a cam block 140 as shown in FIG. 12 and in solid lines in FIG. 11. The handle 37 is adjusted on handle slides 35 to give a brace height officially indicated as eight inches, but actually starting in FIG. 22 at nine-and-three-quarter inches. The limbs are adjusted to provide a maximum draw weight of sixty pounds. As shown, during draw of the bow, the force required to draw the bowstring increases from zero at rest or brace rapidly to about sixty pounds at about nineteen inches, maintaining the sixty pounds to about twenty five inches, and then drops off to about twenty-eight pounds at full draw of thirty inches. If cam block 140 is replaced with a cam block having the configuration shown by broken line 142 in FIG. 11, the bow will have the same brace height and same force-draw curve for the initial portion of the draw, but will drop off sooner from its peak and reach the end of its draw at about twenty-eight inches. If cam block 140 is replaced with a cam block having the configuration shown by broken line 143 in FIG. 11, the bow will have the same brace height and same force-draw curve for the initial portion of the draw, but will drop off from its peak more slowly and not reach the end of its draw until about thirty-two inches. The shape of the curve, i.e., how quickly it rises from zero, how long it remains at peak force, and how fast it drops off from peak force is determined by the shape of the surface of the cam block on which belt 89 is wrapped. Thus, the draw length and force-draw characteristics of the bow are determined by the shape of the cam block and can be easily adjusted by changing the cam block.

For a given cam block, such as cam block 140 providing the force-draw curve of FIG. 22, the position of handle 37 can be changed to change the brace height of the bow and the draw length. Thus, FIG. 22 shows a brace height considered as eight inches and full draw of thirty inches. By sliding handle 37 along handle slides 35 toward the archer a distance of two inches, the brace height is shifted by two inches away from the archer to give a brace height of six inches and a draw length of twenty-eight inches. If the handle is shifted an inch away from the archer, the brace height is increased to nine inches and draw length to thirty-one inches. By adjusting the position of the handle to adjust the brace height and the cam block to adjust the draw length, practically any combination of brace height and draw length can be easily achieved. Further, these adjustments are achieved independently of the adjustment or preload on the limbs. For a particular cam block, such as cam block 140 giving the force-draw curve of FIG. 22, if it is desired to change the peak draw force, leaving the other characteristics substantially the same, the preload on the limbs can be adjusted by screwing screws 110 into bores 109 to further compress the limbs or screwing screws 110 out of bores 109 to reduce the compression of the limbs. With limbs configured and mounted as shown, and with an adjustment of about two and one-half inches, variations in the peak draw force of between about forty to eighty pounds can be obtained.

Figure 6:
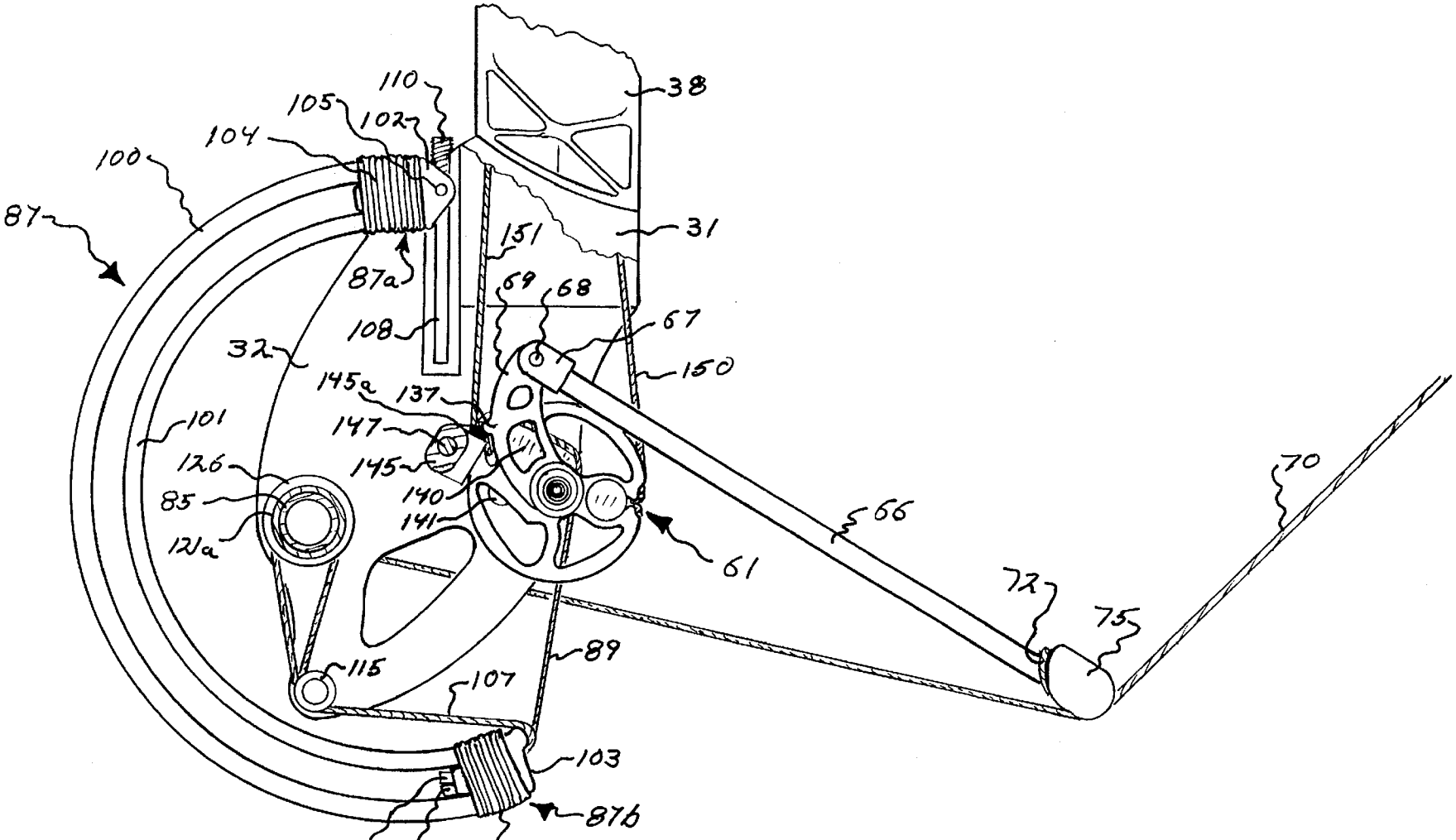

Also, for a given cam block, the amount of let-off, i.e., the reduction in force at full draw compared to the maximum draw force, is dependent upon the degree of rotation of the crank assembly at full draw. It is generally preferred that the let-off be set at about fifty percent as shown in the force-draw curve of FIG. 22. However, depending upon the design of the crank assembly and cam block, let-offs can generally be provided for each cam block of from about zero to ninety percent depending upon the maximum rotation allowed for the crank assembly. In order to provide a positive stop for the crank assembly and a set draw length, a valley adjuster or stop 145, FIGS. 1, 3, and 6, is slidably mounted in slot 146 in side 31 and is held in place by screw 147, FIG. 1. As shown in FIG. 6, valley adjuster 145 is positioned so that, at full draw, rounded guide member 137 which extends from the central portion of crank assembly 61 to the crank portion 69 abuts a stop piece 145*a* extending from valley adjuster 145. The position of valley adjuster 145 determines the amount of rotation of crank assembly 61 allowed to reach full draw of the bow. Valley adjuster stop piece 145*a* is preferably made of a resilient material to provide some give or spring when hit by guide member 137 to provide a valley characteristic at full draw. Valley adjuster stop pieces of various materials may be provided so that an archer can use a stop piece which provides a desired firm, soft or in between feel. While usually valley adjuster 145 will be set to provide about a fifty percent let off at full draw for the particular cam block used, it can be adjusted to give more or less let-off as desired by the archer. Such adjustment will have some effect on the draw length of the bow as increased rotation of the crank assembly will provide some increased draw length.

With the bow of the invention, it is necessary to provide a means for coordinating or synchronizing movement of the upper and lower crank assemblies so that as the bow is drawn or is released, the crank assemblies will rotate together. For this purpose, timing cables 150 and 151, FIGS. 1, 3, 5, and 6, extend from the timing cable receiving portion 90 of the lower crank assembly to the timing cable receiving portion 152 of the upper crank assembly 60. The timing cable receiving portions 90 and 152 of the lower and upper crank assemblies 61 and 60, respectively, are each circular as shown in FIGS. 1 and 5, lower crank assembly 61 being shown in more detail in FIGS. 3, 6, 11, and 12. As shown in FIGS. 4 and 10 for lower crank assembly 61 (upper crank assembly 60 is a mirror image), timing cable receiving portion 90 includes a pair of side-by-side cable receiving grooves 153 and 154. Upper cable receiving portion 152 has corresponding side-by-side cable receiving grooves 155 and 156 as shown in FIG. 8. Cable 150 extends from lower cable receiving groove 153 through hollow riser opening 158, FIGS. 7 and 8, to upper cable receiving groove 155. Cable 151 extends from lower cable receiving groove 154 through hollow riser opening 158 to upper cable receiving groove 156. The cables extend from respective sides of the lower cable receiving grooves to opposite sides of the upper cable receiving grooves and cross in the middle of riser 30 as shown in FIG. 7. This allows each crank assembly to rotate in an opposite direction about its shaft. For example, during draw of the bow as seen from FIGS. 1 and 5, upper crank assembly 60 rotates in a clockwise direction and lower crank assembly 61 rotates in a counterclockwise direction. The directions of rotation are reversed upon release of the bowstring as it moves from drawn to rest position.

Cables 150 and 151 are adjustably secured to each of the crank assemblies in a similar manner which will be described in detail for lower crank assembly 61. As shown in FIGS. 11 and 12, timing cables 150 and 151 extend from their point of contact with cable receiving portions of crank assembly 61 to a timing cable holding and adjusting assembly 158 positioned in an opening 159 extending through timing cable receiving portion 90 of crank assembly 61. This is shown in more detail in FIGS. 23 and 24, with the opening also showing in FIG. 4. As shown in FIGS. 23 and 24, a timing adjuster 160 having an outer cap portion 161 forming shoulder 162 is inserted in opening 159 in crank assembly portion 90 so that shoulder 162 is against the side of portion 90. It is preferred that timing cables 150 and 151 form a unit with a metal fitting 163 cast onto an end of each of cables 150 and 151 as shown in FIG. 23, with a similar fitting cast onto the opposite ends of cables 150 and 151.

Timing adjuster 160 includes a slot 165 extending therethrough with enlarged recess 166 at one end configured to receive and hold fitting 163 therein with cables 150 and 151 extending therefrom through slot 165 as shown in FIG. 24. Cables 150 and 151 extend from timing adjuster 160 through slot 167 in portion 90 of the crank assembly to the respective cable receiving grooves 153 and 154.

A timing adjuster end cap 168, FIG. 23, fits into opening 159 with shoulder 169 abutting the side of portion 90 of the crank assembly. Cap 168 is secured to timing adjuster 160 by screws 170. End cap 168 is spaced slightly from adjuster 160 as shown by space 171 so that by tightening screws 170, end cap 168 is drawn toward adjuster 160 and both end cap shoulder 169 and adjuster shoulder 162 are tightened against timing cable receiving portion 90 of crank assembly 61. In this way, adjuster 160 is held securely against rotational movement. To tighten the timing cables, screws 170 are loosened, an allen wrench is inserted into receiving opening 172, and the adjuster is rotated in opening 159. A rounded recess or cut away area 173 is provided in adjuster 160 at the end of slot 165 so that as the adjuster is rotated, which rotates the orientation of slot 165, the timing cables 150 and 151 will pass through one side or the other of recess 173 to slot 167. With the adjuster rotated, the cables 150 and 151 have a longer path from fitting 163 through slot 165, recess 173, and slot 167, to receiving grooves 153 and 154 then when slots 165 and 167 are aligned as in FIG. 24, and, thereby, the length cables 150 and 151 extending between crank assemblies 60 and 61 are effectively shorted. After the adjuster has been rotated to tighten the cables to the desired degree, screws 170 are tightened to hold the adjuster in place. Openings 174, FIG. 1, through the end portions of sides 31, and similar openings on the opposite side of the bow through the end portions of sides 32, provide access to the allen wrench receiving opening 172 in timing cable adjusters 160 and to screws 170 in timing adjuster end cap 178 to allow tightening of the timing cables when the bow is in rest position. It should be noted that because the timing cables have common end fittings which join the timing cables into a single unit with substantially equal length timing cable, and because the timing cables adjusters tighten both timing cables to substantially the same degree, that other than tightening the cables with the adjuster, no timing adjustment of the bow is needed. The bow is automatically in synchronization.

While a limb has been shown at each end of the riser 30, i.e., an upper limb 86 and lower limb 87, with provision of the timing cables or other means for synchronizing movement of the upper and lower crank assemblies, only a single limb or other energy storage means is needed. This is because when one crank assembly is rotated, the other crank assembly also rotates the same amount, but in the opposite direction. Thus, only one crank assembly has to be coupled to an energy storage means. Currently the two limbs are preferred since two limbs provide about twice the energy storage of only one of the limbs. If a single limb was used, it would have to be made about twice as stiff as each of the limbs to provide the same energy storage as the two limbs.

While the limbs shown are in the form of C-spring limbs, various other energy storage means could be used. For example, straight or other shaped elongate limbs could be used, or various spring arrangements could be used as the limbs. As used herein, limbs are broadly meant to include any type of energy storage device that can be coupled to the crank assemblies. The tapered C-springs are currently preferred because with the C construction, as the ends of the spring are moved toward one another, the line joining the ends moves outwardly from the center of the C thereby increasing the bending leverage of the ends of the spring to provide a relatively constant rate of increase in spring force through the expected range of deformation. Further, the taper from a wider center to narrower tips provides a more consistent and constant bending of the spring over its entire length. This means the spring will desirably maintain an arc shape while bending rather than bending more in the middle of the C than along the outer arms of the C. While two C-springs are shown combined to form the C-limb, the limb could be made up of a single C-spring or more than two C-springs. The two springs shown may each be thinner than a single spring to provide the same energy storage, and since a thinner spring can be bent or deformed more than a thicker spring, the double spring construction shown allows a greater range of preload to be applied to the spring to give the bow a greater range of adjustment.

Further, while the C-limbs are shown as pivotally connected to the end portions of the riser, the limbs could be fixed to the end portion of the riser. In such instance, the control lines provided to restrain rotational movement of the outer ends of the limbs would not be necessary. However, for a fixed attachment to the end portions of the riser, more of the inner limb tip would be used and rigidly mounted so the amount of the spring available for bending and energy storage would be reduced. Also, more stress would be placed on the limb mounting during bending of the limb, and adjustment of limb prestress, which adjusts draw weight, would be difficult. Rigid mounting of the limb would also result in additional weight due to the components necessary for rigid mounting.

The advantages found for the C-limb as described herein apply not only to an archery bow as shown herein, but the same limb arrangement could be used generally where a limb or other energy storage means is used in an archery bow regardless of the arrangement of the bow. Thus, such a limb could advantageously be applied to various types of archery bows to replace the straight limbs or other energy storage means provided for such bows.

Figure 25:
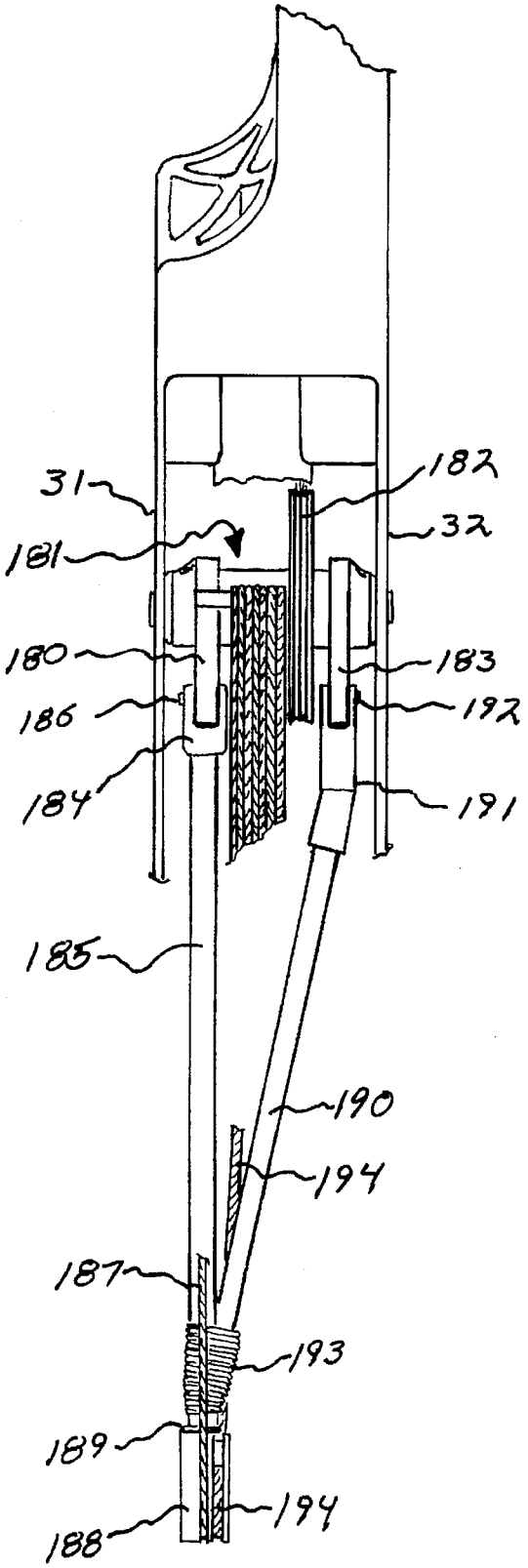

The strut means at each end of the bow have been shown as a single strut pivotally secured to the crank assembly, with two back lines extending from the strut tip to the spread mount to stabilize the strut and counteract substantially all but the axial forces applied to the strut by the bowstring. While the single strut arrangement with two back lines is currently preferred, it results in a relatively wide spread mount. An alternative strut means including two struts and a single back line is shown in FIG. 25. In this embodiment, sides 31 and 32 of the riser will be spaced somewhat wider apart than with the other embodiments shown. The lower crank assembly (the upper crank assembly is a mirror image) is mounted for rotation on an axle between sides 31 and 32 as previously described and includes a crank portion with crank 180, a central belt receiving portion 181, a timing cable receiving portion 182, and a second crank portion with crank 183. A clevis 184 mounted on the end of strut 185 pivotally connects strut 185 to crank arm 180. Bowstring 187 is secured over strut tip 188 with bowstring end loop 189 extending around strut 185, as in the previous embodiment, to secure the bowstring thereto.

In the embodiment of FIG. 25, a second strut 190 is pivotally attached through clevis 191 and pin 192 to crank arm 183. Clevis 191 has to extend outward from crank arm 183 a sufficient distance so that strut 190 extending therefore will not hit and interfere with the timing cables during draw of the bow. The opposite end of second strut 190 is secured to the end of strut 185 just below strut tip 188. The securement includes a filament wrap 193. Alternately, the ends of struts 185 and 190 could be joined by strut tip 188. A single back line 194 is secured to strut tip 188 similarly to the back lines of the prior embodiment and in this embodiment, extends straight back from strut tip 188 to securement with the riser. With two struts with spaced apart ends secured to the crank assembly, only a single back line is necessary. The strut tip is stabilized by the two struts and single back line.

It has been found with the bow of the invention that the force applied to the bowstring by the bow when the bowstring is released is applied by the struts in a substantially outward direction at each end of the riser. Because this force is applied in a substantially outward direction, rather than in a forward direction by movement of the limb tips forwardly as in the conventional compound, the effect of the outward forces at each end of the riser tend to counteract one another so that the bow has reduced recoil and vibration than with a conventional compound bow. Further, since the high energy areas of the bow are isolated on the ends of the bow, there is reduced twisting of the bow, and reduced shock when the bowstring is released and comes to rest. The reduced recoil, vibration, twisting, and shock make the bow smooth to shoot, more accurate, and reduces the noise generated by the bow, and, because stored energy is going into the shooting of the arrow rather than into recoil and vibration forces, the efficiency of the bow is increased. In tests of a prototype bow of the invention, at AMO standard test conditions of thirty inch draw, sixty pound peak draw weight, and at least fifty percent let off, and with an eight inch brace and force-draw characteristics substantially as shown in FIG. 22, the bow was found to have an efficiency of 84.9% and achieve arrow speeds (540 grain arrow) of up to 242 feet per second. Conventional compound bows at standard AMO conditions and eight inch brace have only achieved efficiencies up to about 78% with arrow speeds of up to about 230 feet per second.

Another feature of the bow that adds to the efficiency is the arrangement of the crank assemblies so that the force applied to a crank assembly by the limb or other energy storage means through the belt is applied to the crank assembly on substantially the same side of the crank assembly mounting shaft as the force applied by the bowstring through the strut means. This results in the two forces acting to substantially cancel one-another and substantially reduces the force applied to the shaft of the crank assembly over the force applied to the mounting shaft or axle for the eccentrics of a traditional compound bow. With the traditional compound bow, the bowstring load is applied to an eccentric on one side of the axle and the counteracting buss cable load is applied to the eccentric on the opposite side of the axle so that all of the force is supported by the axle. The bow of the invention, in the preferred embodiment shown, puts both loads on the same side of the shaft or axle to substantially reduce the load on the axle.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An archery bow comprising:

an elongate riser;

energy storage means mounted on said riser;

a first crank assembly rotatably mounted to one end of said riser;

connector means coupling the energy storage means to the first crank assembly so that rotation of the first crank assembly in one direction causes energy storage in said energy storage means and release of energy stored in said energy storage means causes rotation of the first crank assembly in the opposite direction;

a second crank assembly rotatably mounted to the other end of said riser;

means to coordinate movement of the first and second crank assemblies so that rotation of one crank assembly causes rotation of the other crank assembly;

first strut means pivotally secured at a securement end to the first crank assembly;

second strut means pivotally secured at a securement end to the second crank assembly;

a bowstring extending between the ends of the first and second strut means opposite the securement ends, the first and second strut means acting to couple the bow string to the first and second crank assemblies; and means for stabilizing and guiding movement of the first and second strut means as the bowstring is drawn to cause rotation of the first and second crank assemblies so as to store energy in the energy storage means as the bowstring is drawn, and as the first and second crank assemblies rotate upon release of energy from the energy storage means when the bowstring is released from a drawn position.

2. An archery bow according to claim 1, wherein the coupling of the connector means to the energy storage means controls the rate of energy storage in the energy storage means, and wherein the coupling of the connector means to the energy storage means can be changed by an archer to change the rate of energy storage.

3. An archery bow according to claim 1, additionally including a second energy storage means mounted on the riser, and a second connector means coupling the second energy storage means to the second crank assembly so that rotation of the second crank assembly in one direction causes energy storage in the second energy storage means and release of energy stored in the second energy storage means causes rotation of the second crank assembly in the opposite direction.

4. An archery bow according to claim 3, wherein the coupling of the connector means to the energy storage means and the coupling of the second connector means to the second energy storage means controls the rate of energy storage in the respective energy storage means and second energy storage means, and wherein the coupling of the connector means to the energy storage means and the coupling of the second connector means to the second energy storage means can be changed by an archer to change the rate of energy storage.

5. An archery bow comprising:

an elongate riser;

a first limb with one end thereof connected to one end of said riser and extending therefrom with an outer end;

a first crank assembly rotatably mounted to the one end of said riser;

first connector means connecting the outer end of the first limb to the first crank assembly so that rotation of the first crank assembly in one direction causes deformation of the first limb and energy storage therein and movement of the first limb from a deformed condition causes rotation of the first crank assembly in the opposite direction;

a second limb connected to the other end of said riser and extending therefrom with an outer end;

a second crank assembly rotatably mounted to the other end of said riser;

second connector means connecting the outer end of the second limb to the second crank assembly so that rotation of the second crank assembly in one direction causes deformation of the second limb and energy storage therein and movement of the second limb from a deformed condition causes rotation of the second crank assembly in the opposite direction;

first strut means pivotally secured at a securement end to the first crank assembly;

second strut means pivotally secured at a securement end to the second crank assembly;

a bowstring extending between the ends of the first and second strut means opposite the securement ends, the first and second strut means acting to couple the bow string to the first and second crank assemblies;

means for stabilizing and guiding movement of the first and second strut means as the bowstring is drawn to cause rotation of the first and second crank assemblies so as to deform the first and second limbs as the bowstring is drawn, and as the first and second crank assemblies rotate upon movement of the first and second limbs from a deformed position when the bowstring is released from a drawn position; and means to coordinate movement of the first and second crank assemblies.

6. An archery bow according to claim 5, additionally including guide means to guide movement of the outer ends of the limbs as the crank assemblies rotate.

7. An archery bow according to claim 6, wherein the first and second limbs are pivotally connected to the respective ends of the riser, and the guide means to guide movement of the outer ends of the limbs are cable means extending between the riser and the free ends of the limbs to restrain rotational movement of the limbs about their respective pivot connections.

8. An archery bow according to claim 7, wherein the bow has a draw weight, wherein the respective positions of the pivotal connections of the first and second limbs to the ends of the riser are adjustable, and wherein adjustment of the respective positions of the pivotal connections adjust the draw weight of the bow.

9. An archery bow according to claim 5, wherein the bow has a draw weight, wherein the first limb is adjustably connected to the riser, wherein the second limb is adjustably connected to the riser, and wherein adjustment of the connections of the first and second limbs to the riser adjusts the draw weight of the bow.

10. An archery bow according to claim 5, wherein the first connector means is belt means extending from the outer end of the first limb to the first crank assembly and rotation of the first crank assembly in the one direction winds a portion of said belt means progressively onto a control portion of the first crank assembly to cause deformation of the first limb, and wherein the second connector means is belt means extending from the outer end of the second limb to the second crank assembly and rotation of the second crank assembly in the one direction winds a portion of said belt means progressively onto a control portion of the second crank assembly to cause deformation of the second limb.

11. An archery bow according to claim 10, wherein the configuration of the control portions of the first and second crank assemblies control the rate of deformation of the first and second limbs and energy storage therein.

12. An archery bow according to claim 11, wherein at least a portion of the control portions of the first and second crank assemblies are separately formed as removable pieces and replaceable by other removable pieces to change the configuration of the control portions of the first and second crank assemblies.

13. An archery bow according to claim 11, wherein the bow has a draw length, and wherein the configuration of the control portions of the first and second crank assemblies have an effect on the draw length of the bow.

14. An archery bow according to claim 5, wherein the bow has a draw length and a let off, and wherein the means for stabilizing and guiding movement of the first and second struts is adjustable to adjust the draw length and let off the bow.

15. An archery bow according to claim 5, wherein the bow has a let off, and wherein the amount of rotation of one of the crank assemblies can be adjusted to adjust the let off of the bow.

16. An archery bow according to claim 5, wherein the bow has a brace height, and additionally including handle slide means extending from the elongate riser, and a handle mounted for sliding movement along the handle slide means whereby the position of the handle can be adjusted to adjust the brace height of the bow.

17. An archery bow according to claim 5, wherein the means for stabilizing and guiding movement of the first and second strut means are back lines which extend from the ends opposite the securement ends of respective strut means to connection with the riser.

18. An archery bow according to claim 17, wherein the first strut means is pivotally secured at a single pivot securement to the first crank assembly, wherein the second strut means is pivotally secured at a single pivot securement to the second crank assembly, and wherein the means for stabilizing and guiding movement of the first and second strut means are a pair of back lines extending from the end opposite the securement end of the first strut means to horizontally spaced apart securement to the riser and a pair of back lines extending from the end opposite the securement end of the second strut means to horizontally spaced apart securement to the riser.

19. An archery bow according to claim 17, wherein the first strut means is pivotally secured to the first crank assembly at horizontally spaced apart pivot securement points, wherein the second strut means is pivotally secured to the second crank assembly at horizontally spaced apart pivot securement points, and wherein the means for stabilizing and guiding movement of the first and second strut means is a single back line extending from the end opposite the securement end of the first strut means to securement to the riser and a single back line extending from the end opposite the securement end of the second strut means to securement to the riser.

20. In an archery bow having rotatable elements which are rotated about an axis as a bowstring moves between a rest and drawn position, and wherein at least one energy storage means is coupled to the rotatable elements so that as the rotatable elements move in response to drawing the bowstring, the energy storage means deforms and stores energy and when the bowstring is released, the energy storage means causes rotation of the rotatable elements to forcibly move the bowstring to its rest position; the improvement wherein the at least one energy storage means is at least one C-spring having one end pivotally connected to the bow and the opposite end coupled to the rotatable elements; and means for guiding movement of the opposite end as it moves in response to movement of the rotatable elements.

* * * * *